US009184013B2

(12) United States Patent
Narayanasamy et al.

(10) Patent No.: US 9,184,013 B2
(45) Date of Patent: Nov. 10, 2015

(54) CONDUCTOR GUIDE MEMBER FOR A CIRCUIT BREAKER TERMINAL ASSEMBLY

(71) Applicant: General Electric Company, Schenectady, NY (US)

(72) Inventors: Soundararajan Narayanasamy, Andhra Pradesh (IN); Wolfgang Meyer-Haack, Neumuenster (DE); Janakiraman Narayanan, Andhra Pradesh (IN); Devendra Kumar Sharma, Andhra Pradesh (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 157 days.

(21) Appl. No.: 13/923,694

(22) Filed: Jun. 21, 2013

(65) Prior Publication Data

US 2014/0374226 A1 Dec. 25, 2014

(51) Int. Cl.

| | |
|---|---|
| ***H01H 33/02*** | (2006.01) |
| ***H01H 71/08*** | (2006.01) |
| ***H01H 1/58*** | (2006.01) |
| *H01H 1/22* | (2006.01) |

(52) U.S. Cl.

CPC ..... *H01H 71/08* (2013.01); *H01H 1/5822* (2013.01); *H01H 1/22* (2013.01); *Y10T 29/49105* (2013.01)

(58) Field of Classification Search

CPC ..... H01H 71/08; H01H 1/5822; H01H 1/22; H01H 1/06; H01H 33/6606

USPC ..... 200/237; 29/622; 335/18

See application file for complete search history.

(56) References Cited

U.S. PATENT DOCUMENTS

| | | | | |
|---|---|---|---|---|
| 4,649,242 | A | 3/1987 | Kralik | |
| 4,679,016 | A | 7/1987 | Ciarcia et al. | |
| 5,434,376 | A | 7/1995 | Hyatt et al. | |
| 5,796,061 | A | 8/1998 | Fabrizi et al. | |
| 5,978,208 | A | 11/1999 | Helms et al. | |
| 6,172,586 | B1 | 1/2001 | Ferree et al. | |
| 6,211,759 | B1 * | 4/2001 | Little et al. | 335/202 |
| 6,307,453 | B1 * | 10/2001 | Wellner et al. | 335/6 |
| 6,437,268 | B1 | 8/2002 | Etscheidt et al. | |
| 6,974,351 | B1 * | 12/2005 | Lauk et al. | 439/651 |
| 7,495,534 | B2 | 2/2009 | Oh | |
| 7,609,137 | B2 | 10/2009 | Roesner et al. | |
| 7,935,902 | B2 * | 5/2011 | Newase et al. | 200/244 |
| 2006/0061441 | A1 * | 3/2006 | Whipple et al. | 335/132 |
| 2008/0153362 | A1 * | 6/2008 | Pijoan Parellada et al. | 439/816 |
| 2009/0255792 | A1 * | 10/2009 | Newase et al. | 200/244 |
| 2011/0209972 | A1 * | 9/2011 | Eppe et al. | 200/293 |

FOREIGN PATENT DOCUMENTS

WO 9900810 A1 1/1999

OTHER PUBLICATIONS

Baker et al., "A New 69-Kv Compressed-Air Circuit Breaker", American Institute of Electrical Engineers, Jul. 1949, vol. 68, pp. 363-372.

* cited by examiner

*Primary Examiner* — Kyung Lee

(74) *Attorney, Agent, or Firm* — GE Global Patent Operation; Stephen G. Midgley

(57) ABSTRACT

A conductor guide member for a circuit breaker terminal assembly includes a body having at least one conductor guide surface configured and disposed to facilitate alignment between at least one terminal connection member of the terminal assembly and at least one conductor. The at least one conductor guide surface gradually slopes from a first end to a second end. The second end defines a recess.

9 Claims, 3 Drawing Sheets

CONDUCTOR GUIDE MEMBER FOR A CIRCUIT BREAKER TERMINAL ASSEMBLY

BACKGROUND OF THE INVENTION

The subject matter disclosed herein relates to the art of circuit breakers and, more particularly, to a conductor guide member for a circuit breaker terminal assembly.

Circuit breakers, such as those employed in various industrial applications, include multiple sections that may be field repaired and/or replaced. For example, many circuit breakers include a main body, an upper terminal assembly, and a lower terminal assembly. The upper terminal assembly generally includes contacts connected to upper terminals. The upper terminals are generally connected to an electrical load. The lower terminal assembly generally includes electrical contacts connected to lower terminals that are generally connected to an electrical source. The terminal assembly also typically includes a moving arm that shifts moveable contacts into and out of engagement with the electrical contacts in the upper terminal assembly. The moveable contacts are typically connected to the lower terminals through foils or conductors.

Disassembly of the lower terminal assembly for repair often times requires disconnecting the conductors from the lower terminals. Field removal of the conductors is very difficult at best. Reconnecting the conductors with the lower terminals in the field is even more difficult if not impossible. Aligning connection points on the conductors and the lower terminals in the field is difficult if not impossible at times. Accordingly, field repair of the terminal assembly is often times a frustrating and time consuming operation. Thus, in most cases, repair of the terminal assembly requires the complete removal of the circuit breaker. Complete removal of the circuit breaker increases the time involved with implementing a repair procedure.

BRIEF DESCRIPTION OF THE INVENTION

According to one aspect of an exemplary embodiment, a conductor guide member for a circuit breaker terminal assembly includes a body having at least one conductor guide surface configured and disposed to facilitate alignment between at least one terminal connection member of the terminal assembly and at least one conductor. The at least one conductor guide surface gradually slopes from a first end to a second end. The second end defines a recess.

According to another aspect of an exemplary embodiment, a terminal assembly for a circuit breaker includes a bracket element, and a terminal fixedly connected to the bracket element. The terminal includes at least one connection member. A moveable terminal is supported by the bracket element. At least one conductor includes a first end portion electrically coupled to the moveable terminal and a second end portion having a connection element electrically coupled to the terminal. A conductor guide member is connected to the bracket element. The conductor guide member includes a body having at least one conductor guide surface configured and disposed to facilitate alignment between the at least one connection member of the terminal and the second connection element of the at least one conductor. The at least one conductor guide surface gradually slopes from a first end to a second end. The second end defines a recess.

According to yet another aspect of an exemplary embodiment, a method of connecting a conductor to a circuit breaker terminal assembly includes passing an end of the conductor along at least one conductor guide surface, positioning a connection element provided on the end of the conductor adjacent a connection member provided on a terminal of the circuit breaker, and aligning the connection element with the connection member.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
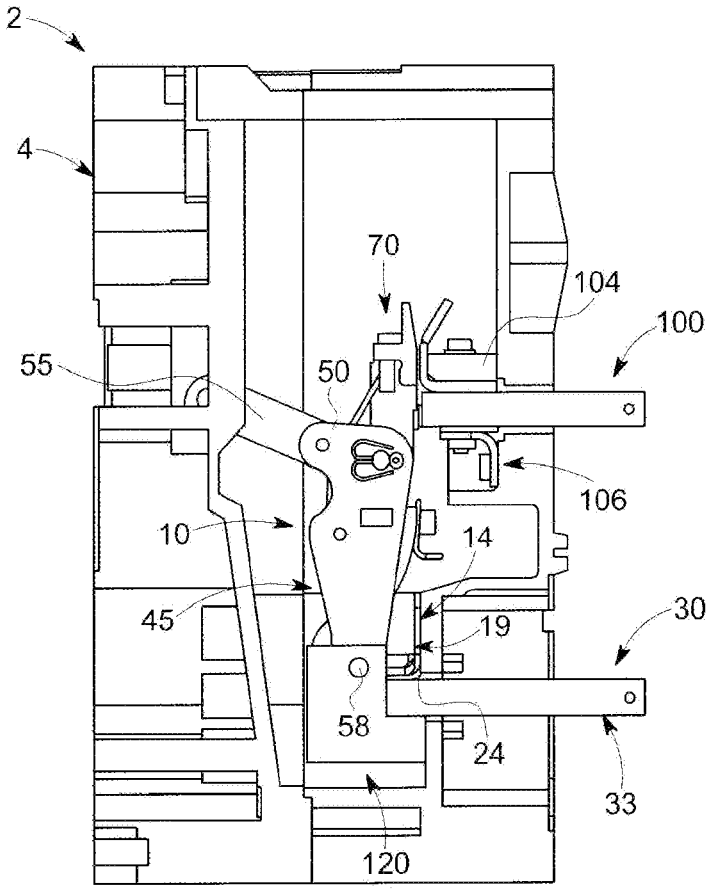
FIG. 1 is a partial cross-sectional side view of a circuit breaker having a terminal assembly provided with a conductor guide member in accordance with an exemplary embodiment.
Figure 2:
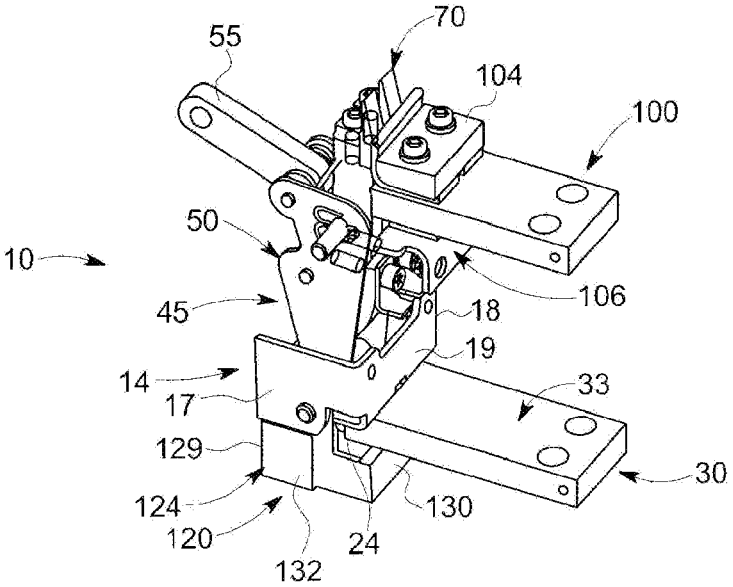
FIG. 2 is a perspective view of the terminal assembly of FIG. 1.
Figure 3:
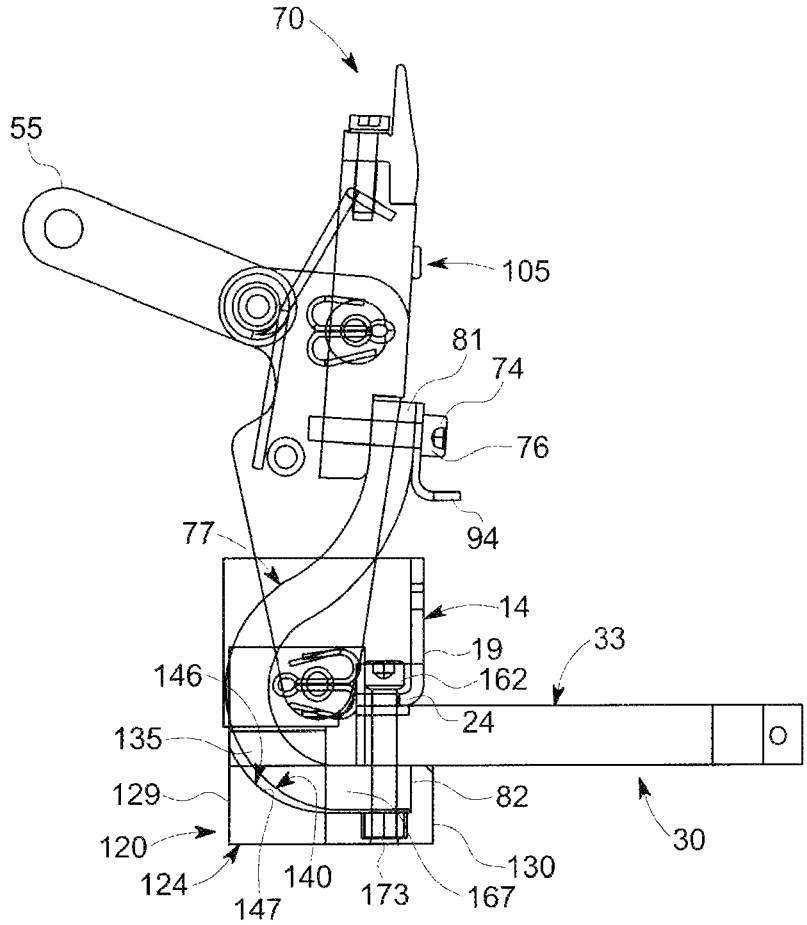
FIG. 3 is a side view of the terminal assembly of FIG. 2.
Figure 4:
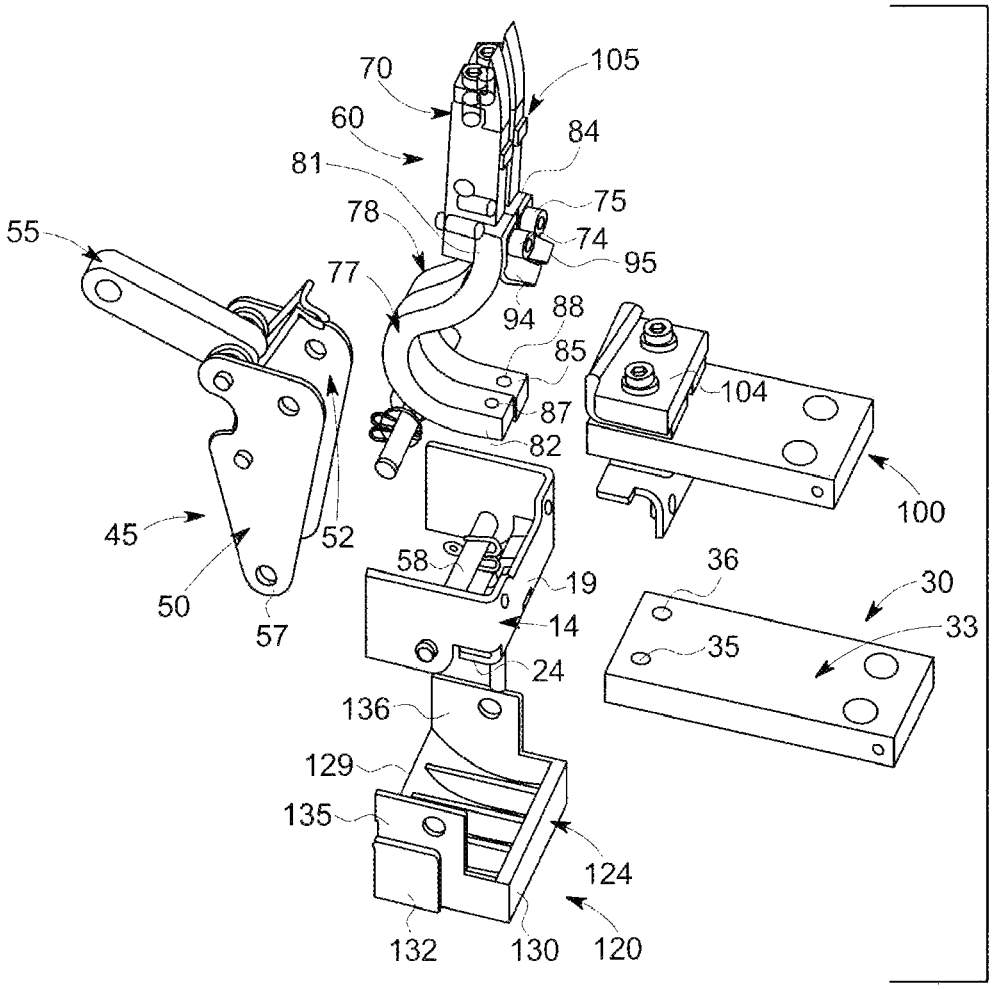
FIG. 4 is an exploded view of the terminal assembly of FIG. 2.

A circuit breaker in accordance with an exemplary embodiment is indicated generally at 2 in FIG. 1. Circuit breaker 2 includes a front housing 4 that supports a terminal assembly 10. Front housing 4 is connected to a rear housing (not shown) through one or more fasteners (also not shown). Terminal assembly 10 is accessed by removing front housing 4 from the rear housing. In the exemplary embodiment shown, terminal assembly 10 takes the form of a lower terminal assembly for an industrial circuit breaker. The term "industrial circuit breaker" should be understood to be a circuit breaker having a voltage rating of up to about 1000 volts and a current rating of up to about 6400 amperes. As shown in FIGS. 2-4, terminal assembly 10 includes a bracket element 14 having a first end 17 that extends to a second end 18 through an intermediate portion 19. A terminal mounting section 24 extends from intermediate portion 19 between first and second ends 17 and 18. Terminal mounting section 24 supports a stationary or fixed terminal 30. Fixed terminal 30 includes a terminal body 33 including a first connection member 35 and a second connection member 36. As will be discussed more fully below, first and second connection members 35 and 36 facilitate an attachment between fixed terminal 30 and bracket element 14.

Bracket element 14 also supports a moving arm assembly 45. Moving arm assembly 45 includes a first plate 50 spaced from a second plate 52. An actuator or lever 55 is pivotally mounted between first and second plates 50 and 52. First and second plates 50 and 52 each have an opening such as shown at 57 on first plate 50 that receives a pin 58. Pin 58 pivotally links first and second plates 50 and 52 to bracket element 14. First and second plates 50 and 52 also support a moveable contact assembly 60 including a contact support member 70. Contact support member 70 includes a first mounting element 74 and a second mounting element 75. First and second mounting elements 74 and 75 take the form of threaded fasteners such as indicated at 76 in FIG. 3.

First and second mounting elements 74 and 75 join a first conductor 77 and a second conductor 78 to contact support member 70. First and second conductors 77 and 78 may take the form of flexible conductor foils or braided flexible conductors (not separately labeled). First conductor 77 includes a first end portion 81 that extends to a second end portion 82. Similarly, second conductor 78 includes a first end portion 84 that extends to a second end portion 85. First end portions 81 and 84 of first and second conductors 77 and 78 are joined to contact support member 70 through first and second mounting elements 74 and 75. Each second end portion 82 and 85 include corresponding terminal mounting elements 87 and 88 which, as will be detailed more fully below, are employed in joining first and second conductors 77 and 78 to fixed terminal 30. First and second mounting elements 74 and 75 also connect a first terminal element 94 and a second terminal element 95 to contact support member 70. First and second terminal elements 94 and 95 are employed to electrically connect first and second conductors 77 and 78 to a moveable terminal 100 as will be detailed more fully below. Mounting hardware, indicated generally at 104, supports moveable terminal 100 to mounting pads 105 provided on contact support member 70. Mounting hardware 104 includes terminal connectors, such as shown at 106, that facilitate an electrical link between conductors 77 and 78 and moveable terminal 100. More specifically, terminal connectors 106 are linked to first and second terminal mounting elements 94 and 95 through conductors (not shown).

Occasionally, there is a need to remove moveable contact assembly 60 for repair. Removing moveable contact assembly 60 requires disconnecting second end portions 82 and 85 of first and second conductors 77 and 78 from fixed terminal 30. Disconnecting first and second conductors 77 and 78 is a relatively easy operation. However, with conventional circuit breakers, re-establishing the connection can prove to be difficult or at the very least frustrating. Aligning the first and second connection elements 87 and 88 with first and second connection members 35 and 36 requires a great deal of time and more than a little bit of luck. As such, reconnecting moveable contact assembly 60 in prior art circuit breakers would generally involve removal and disassembly of terminal assembly 10 from housing 4. In accordance with an exemplary embodiment, luck and/or the removal of terminal assembly 10 to re-establish a connection between first and second conductors 77 and 78 and fixed terminal 30 is no longer necessary.

Figure 5:
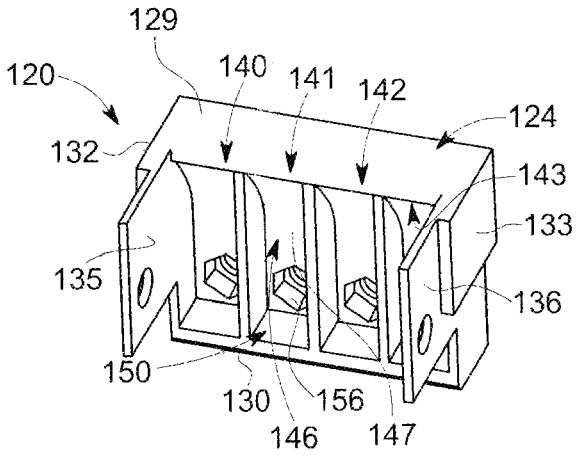
FIG. 5 is a perspective view of the conductor guide member of FIG. 1.

In accordance with an exemplary embodiment, terminal assembly 10 includes a conductor guide member 120. As shown in FIG. 5, conductor guide member 120 includes a body 124 having a first end section 129 and a second end section 130. First and second end sections 129 and 130 extend between first and second side sections 132 and 133. First side section 132 supports a first mounting member 135 and second side section 133 supports a second mounting member 136. First and second mounting members 135 and 136 provide structure that establishes a connection between conductor guide member 120 and bracket element 14. Conductor guide member 120 facilitates alignment between first and second connection elements 87 and 88 with first and second connection members 35 and 36. More specifically, conductor guide member 120 includes a plurality of conductor guide surfaces 140-143 that extend between first and second end sections 129 and 130. In the exemplary embodiment shown, guide surfaces 141 and 142 cooperate with first and second conductors 77 and 78, the remaining guide surfaces may be used for additional conductors.

At this point, reference will be made to conductor guide surface 141 with an understanding that conductor guide surfaces 140, 142, and 143 include similar geometry. Conductor guide surface 141 includes at least one conductor guide surface 146 that extends from an outer edge (not separately labeled) of first end section 129 along a generally arcuate path to second end section 130 forming a recess 150. In accordance with one aspect of the exemplary embodiment, at least one conductor guide surface 146 includes a substantially smooth curvilinear guiding surface 147 that is configured to guide a conductor end into a desired position. In accordance with an aspect of the exemplary embodiment, curvilinear guiding surface 147 is formed as a series of angular surfaces. Recess 150 is sized so as to generally correspond to a thickness of the conductors as shown in FIG. 3. A fastener receiving portion 156 is formed in conductor guide surface 141 at recess 150. With this arrangement, second end portion 82 of first conductor 77 is guided along conductor guide surface 141 toward recess 150. Second end section 130 is arranged such that conductor guide surface 141 aligns first connection element 87 with first connection member 35. Once aligned, a mechanical fastener 162 such as a bolt is passed through first connection member 35 and first connection element 87 as shown in FIG. 3. Mechanical fastener 162 includes a threaded portion 167 that engages with a mechanical fastener element or nut 173 that is captured within fastener receiving portion 156. "Captured" should be understood to imply that mechanical fastener element 173 is prevented from rotating when mechanical fastener 162 is tightened and/or loosened.

At this point it should be understood that the exemplary embodiment or embodiments describe a conductor guide member that facilitates alignment between conductors or foils and a terminal in a circuit breaker. The conductor guide member includes one or more guide surfaces that position an end portion of a conductor adjacent to a terminal. The conductor guide surface also facilitates alignment of a connection element or opening formed in the conductor with a connection member or opening formed in the terminal. The conductor guide surface also includes structure that retains a fastener element such as a nut. Further, while shown as including four conductor guide surfaces that guide two conductors into a desired position, the number of guide surfaces and conductors may vary. In addition, while the circuit breaker is shown with two contacts, the number of contacts could vary. Also, while described as being part of a lower terminal assembly, the exemplary embodiments can be incorporated into various other types of terminal assemblies. For example, the conductor guide surface(s) could be materially integrally formed with the housing.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A terminal assembly for a circuit breaker comprising:

a bracket element;

a terminal fixedly connected to the bracket element, the terminal including at least one connection member;

a moveable terminal supported by the bracket element;

at least one conductor including a first end portion electrically coupled to the moveable terminal and a second end portion having a connection element electrically coupled to the terminal; and a conductor guide member connected to the bracket element, the conductor guide member including a body having at least one conductor guide surface configured and disposed to facilitate alignment between the at least one connection member of the terminal and the second connection element of the at least one conductor, wherein the at least one conductor guide surface gradually slopes from a first end to a second end, the second end defining a recess.

2. The terminal assembly according to claim 1, wherein the conductor guide member includes a fastener receiving portion.

3. The terminal assembly according to claim 1, wherein the fastener receiving portion is provided in the recess of the at least one conductor guide surface.

4. The terminal assembly according to claim 3, further comprising: at least one mechanical fastener extending through the at least one connection member and the second connection element, the at least one mechanical fastener including a threaded portion.

5. The terminal assembly according to claim 4, further comprising: a mechanical fastener element captured in the fastener receiving portion, the mechanical fastener element engaging with the threaded portion of the at least one mechanical fastener.

6. The terminal assembly according to claim 1, wherein the conductor guide member includes one or more mounting members extending substantially perpendicularly relative to the at least one conductor guide surface, the one or more mounting members being configured and disposed to connect with the bracket element.

7. The terminal assembly according to claim 1, wherein the moveable terminal constitutes a lower terminal assembly for an industrial circuit breaker having a voltage rating of up to about 1000 volts and a current rating of up to about 6400 amperes.

8. The terminal assembly according to claim 1, wherein the at least one conductor comprises one of a flexible foil and a braided flexible conductor.

9. The terminal assembly according to claim 1, wherein the at least one conductor guide surface comprises a substantially curvilinear guiding surface.

* * * * *